US005998750A

United States Patent [19]

Wegener et al.

[11] Patent Number: 5,998,750

[45] **Date of Patent: *Dec. 7, 1999**

[54] CIRCUIT BREAKER OPERATOR WITH PUSH TO TEST ARRANGEMENT

[75] Inventors: John A. Wegener, Broken Arrow; Joe K. Hall, Owasso; Richard C. Emerson, Broken Arrow, all of Okla.

[73] Assignee: EGS Electrical Group LLC, Chicago, Ill.

[ * ] Notice: This patent is subject to a terminal disclaimer.

[21] Appl. No.: 09/167,240

[22] Filed: Oct. 6, 1998

Related U.S. Application Data

[62] Division of application No. 08/904,218, Jul. 31, 1997, Pat. No. 5,861,591.

[51] Int. Cl.[6] ..... H01H 1/20; H01H 3/20; H01H 3/08

[52] U.S. Cl. ..... 200/564; 200/17 R; 200/50.32; 200/330; 200/336

[58] Field of Search ..... 200/4, 50.01, 50.06, 200/50.1, 50.12–50.14, 50.32, 401, 17 R, 500, 501, 564, 330, 331, 334, 336, 337; 218/1, 154; 335/18, 9, 21, 16, 161

[56] References Cited

U.S. PATENT DOCUMENTS

| | | | |
|---|---|---|---|
| 3,873,797 | 3/1975 | Hannich | 200/308 |
| 4,282,500 | 8/1981 | Ducroquet et al. | 335/18 |
| 4,409,574 | 10/1983 | Misencik et al. | 335/18 |
| 5,111,009 | 5/1992 | Chan et al. | 200/330 |
| 5,180,050 | 1/1993 | Rada et al. | 200/329 |
| 5,219,070 | 6/1993 | Grunert et al. | 200/330 |
| 5,286,935 | 2/1994 | Mina et al. | 200/330 |
| 5,493,084 | 2/1996 | Whitaker et al. | 200/50 A |
| 5,577,603 | 11/1996 | Bodganovs et al. | 200/331 |
| 5,861,591 | 1/1999 | Wegener et al. | 200/50.32 |

*Primary Examiner*—Michael Friedhofer
*Attorney, Agent, or Firm*—Howell & Haferkamp. LC

[57] ABSTRACT

A circuit operator with a push to test arrangement includes a housing. A first switch is mounted in the housing and has a toggle lever pivotably connected thereto so as to place the toggle switch in its on or off state. A second switch is also mounted in the housing and is connected to a push button for initiating tests. A single switch actuator allows a user to actuate the first switch and/or the second switch from an exterior of the housing.

22 Claims, 3 Drawing Sheets

CIRCUIT BREAKER OPERATOR WITH PUSH TO TEST ARRANGEMENT

This is a divisional of application Ser. No. 08/904,218; filed on Jul. 31, 1997, now U.S. Pat. No. 5,861,591.

FIELD OF THE INVENTION

The present invention relates to circuit breaker operators and, more specifically, to circuit breaker operators having an integral push to test arrangement and a misalignment indicator.

BACKGROUND OF THE INVENTION

The use of switches in electrical circuits associated with machinery and other equipment are known in the art. Switches such as circuit breakers typically control the flow of electrical current and may take the form of a toggle switch with a lever that is manually operated between the ON and OFF positions to complete or interrupt the electrical circuit. Such switches are frequently placed in protective enclosures when used in explosive atmospheres (i.e., an environment containing flammable vapors) or otherwise harsh environments. Protective enclosures provide a measure of safety, i.e., by creating a barrier between flaming gases and the personnel operating the switches.

For switches housed in an enclosure, a remote operating device may be utilized to penetrate the enclosure walls and allow the switches to be externally operated. This is often the case for explosion-proof or hazardous location-related enclosures in which an externally operated switch may be required.

Prior art remote operators, however, are limited in their function. They are only capable of turning ON or OFF a single corresponding switch per remote operator. However, in practice, circuits may have coupled thereto a plurality of switches such as a circuit breaker, fault test initiators and so forth. Given the limitations of current remote operators, the additional switches associated with the circuits must either be operated by a person from an internal position in the enclosure (i.e., opening the panel and operating the switch), or a separate remote operator must be incorporated into the enclosure for those additional switches. For the former case, the internal operation of a switch is impractical and especially dangerous for explosion-proof or hazardous location-related enclosures, as described above. For the latter case, the incorporation of additional remote operators into the enclosure increases the overall cost of the system and, more importantly, decreases the overall integrity of the enclosure by requiring additional holes to be drilled into the enclosure.

Accordingly, there is a desire to provide a remote operator that is capable of functioning to operate a toggle switch in a circuit breaker or the like, and concomitantly therewith a push to test switch.

Other problems associated with prior art remote operators also involve the misalignment of the remote operator with respect to the toggle lever, when the panel of the enclosure is in the closed position. For example, during product assembly, installation and maintenance, the door must be opened and the remote operator disengaged with the circuit breaker in either the ON or OFF position. Reclosing the door with a misaligned operator prevents the operator from engaging the breaker toggle, leaving the circuit breaker inoperable. Moreover, the occurrence of a misalignment may not be apparent, particularly in light of the fact that the door is in the closed position thereby preventing a view of the operator and switch.

In addition, misalignment is typically remedied by painstakingly guiding the operator onto a toggle lever (for actuating a switch) as the door closes. This task is performed blindly, requiring the person making the adjustment to do so with the enclosure door closed (i.e., not seeing how the operator mates with the toggle lever).

One approach to remedy the above problem is to employ a remote, self-adjusting operator as disclosed in U.S. Pat. No. 5,286,935 to Mina et al. and U.S. Pat. No. 5,577,603 to Bogdanovs et al. Both remote operators automatically move into an aligned position with respect to the toggle lever, when the door to the enclosure is closed. Such devices do not provide or require an indication of a misalignment.

There is a desire to provide an alternative approach to the misalignment problem in which a circuit operator able of indicating a misalignment of the circuit operator with respect to the toggle lever, when the door of the enclosure is in the closed position. There is also a desire to provide a circuit operator that provides a safe and easy method for realigning the circuit operator with the toggle-lever when the door of the enclosure is in the closed position.

In view of the foregoing, it is an object of the present invention to provide a circuit operator that is capable of externally operating multiple switches, i.e., a circuit breaker and fault test switch, maintained in a housing.

It is a further object of the invention to construct the above circuit operator such that fewer holes need to be drilled in the housing, thereby proving a stronger housing that requires less materials and reduces the assembly time of the overall device.

Another object of the invention is to provide a misalignment indicator-which indicates a misalignment of a switch actuator, when a cover of the housing is in the closed position.

It is still yet a further object of the invention to provide a circuit operator-that provides a simple, easy method for realigning the switch actuator, when an openable cover of the housing is in the closed position.

SUMMARY OF THE INVENTION

A circuit operator with a push to test arrangement includes a housing. A first switch is mounted in the housing and has a toggle lever pivotably connected thereto so as to place the toggle switch in its on or off state. A second switch is also mounted in the housing and is connected to a push button for initiating tests. A single-switch actuator allows a user to actuate the first switch or the second switch from an exterior of the housing.

The switch actuator preferably includes a plate positioned in the housing and having a first surface and second surface opposite the first surface. The first surface has two feet, preferably in parallel, that extend therefrom to position on opposing sides of the toggle lever of the first switch. The plate further includes a surface portion adjacent to the feet and opposing the second switch. The switch actuator further includes a plate operating mechanism, preferably an external handle coupled to the plate across a shaft that passes through the housing. The plate operating mechanism can be operated externally (i.e., via the handle) to move the plate in a first and second direction (i.e., longitudinal direction) to toggle the toggle lever between the feet and/or in a third and fourth direction (i.e., axial direction), orthogonal to the first and second directions, to trigger the second switch.

As can be appreciated, the present invention allows a manufacturer to produce a housing with fewer holes therein and, thus, capable of having thinner walls. This results in a stronger housing for withstanding explosive pressure, particularly in an industry where minimizing the wall thickness of the housing is very important. The present invention further reduces the cost of the housing by reducing drilling time and assembly time.

The present invention also includes a misalignment feature which indicates a misalignment of the switch actuator, when an openable cover of the housing is in the closed position. A misalignment of the switch actuator occurs when either feet of the plate are in contact with an upper surface of the toggle lever and a cover member of the housing is in the closed position (a MISALIGNED position). This unexpected contiguity forces the plate, to move in the axial direction towards the housing which, in turn, forces the gear and shaft also to move in the axial direction towards the housing. As a result, the externally positioned handle moves away from the housing. The movement of the external handle as well as the distance between the handle and the exterior of the housing indicates the occurrence of a misalignment between the switch actuator and the toggle lever.

DETAILED DESCRIPTION OF THE PREFERRED EMBODIMENTS

Figure 1:
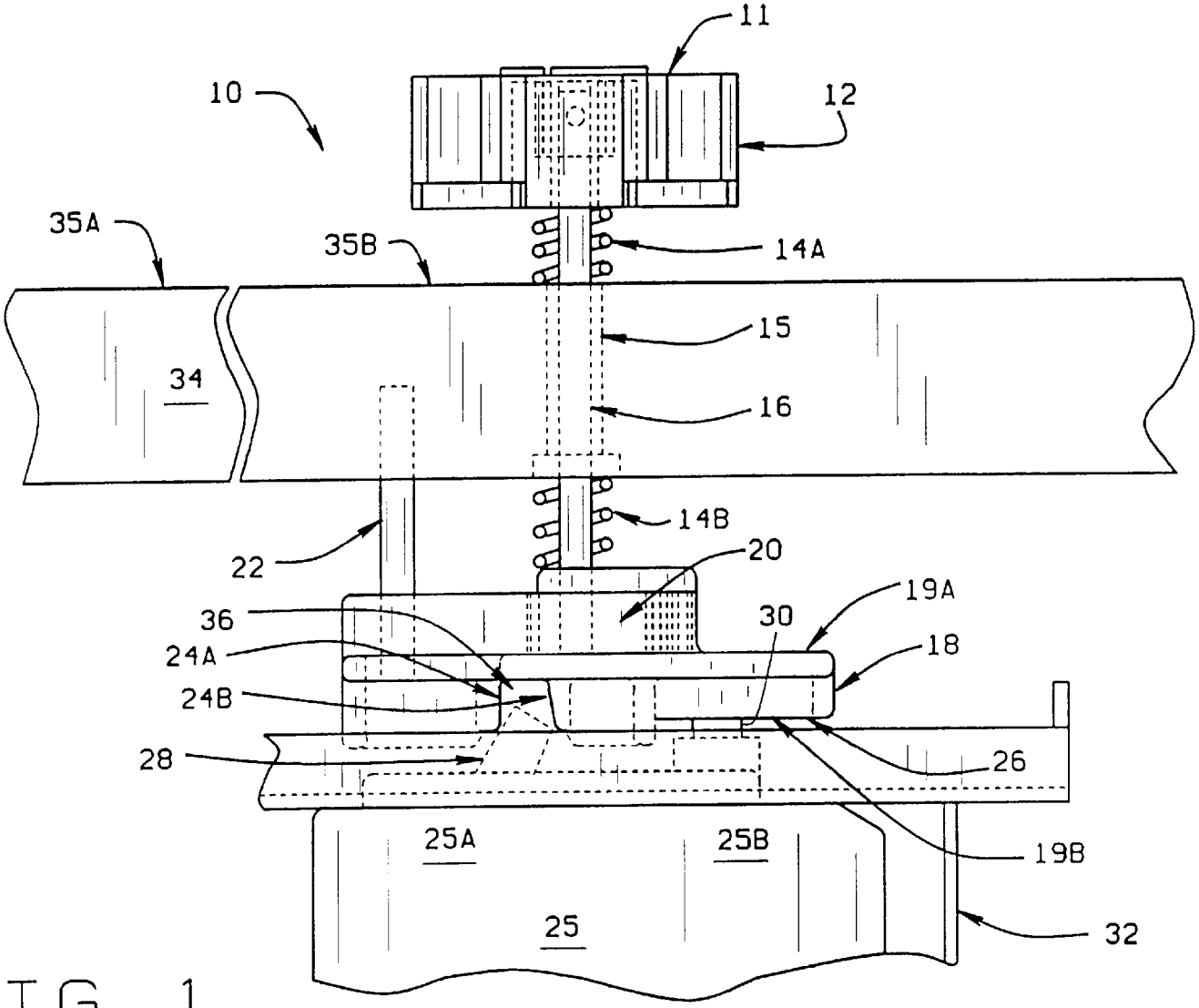
FIG. 1 is a cross-sectional view of a circuit breaker operator in accordance with the present invention.

Referring to FIG. 1, a circuit breaker operator 10 provides a housing having therein multiple switches 25A, 25B such as a circuit breaker and a switch which energizes a ground fault simulation circuit and a switch actuator 11 having an external handle 12 for providing external operation of the multiple switches. Handle 12 can be rotated in either direction to operate a first switch 25A, i.e. a circuit breaker, and moved towards and away from the housing to activate a second switch 25B, i.e., a ground fault simulation circuit.

In particular, circuit breaker operator 10 includes a housing 34 having mounted therein a panel board 32 having a plurality of switches 25 including at least a first switch 25A and/or a second switch 25B. Housing 34 comprises a body portion 35A and an openable cover member 35B for allowing access to an interior of housing 34. Cover member 35B includes an aperture 15 thereon for receiving a portion of a shaft therethrough. Body portion 35A and cover member 35B are made from a suitably strong material, such as cast aluminum, to withstand explosive pressures from within or hazardous environmental conditions. Body portion 35A and cover member 35B can be connected together by hinges or other suitable means.

Circuit breaker 25 has positioned thereon a toggle lever 28 for turning first switch 25A to an ON or OFF state. It is preferred that first switch 25A is a circuit breaker. Circuit breaker 25 further has positioned thereon a push button 30, adjacent to toggle lever 28, for operating second switch 25B which preferably initiates a fault test. It is preferred that second switch 25B is a switch for a test circuit such as a ground fault interrupt (GFI) simulator (not shown). The ground fault simulation circuit (not shown), when activated, causes first switch 25A to trip. Although FIG. 1 only describes two switches, panel board 32 may include a plurality of switches for operating various circuits contained therein. In fact, panel board 32 must not necessarily be present for this plurality of switches to be present and functional.

Circuit operator 10 further includes a switch actuator 11 for operating both toggle lever 28 and push button 30. Switch actuator 11 includes a handle 12 located on an exterior of cover member 35B, a plate 18 having a first surface 19A and a second surface 19B (FIGS. 1 and 3) opposite first surface 19A, and a shaft 16 having a portion passing through aperture 15 and connected between handle 12 and first surface 19A of plate 18 by way of a gear 20. Shaft 16 is connected to first surface 19A of plate 18 by way of gear 20 such that rotational movement of handle 12 is translated into longitudinal movement of plate 18 and axial movement of handle 12, i.e. towards and away from housing 12, moves plate 18 towards and away from circuit breaker 25. Handle 12 can thus be rotated in either direction to move plate 18 in the longitudinal directions and moved in the axial directions (i.e., towards and away from housing 12) to move plate 18, likewise, in a corresponding axial direction.

Figure 3:
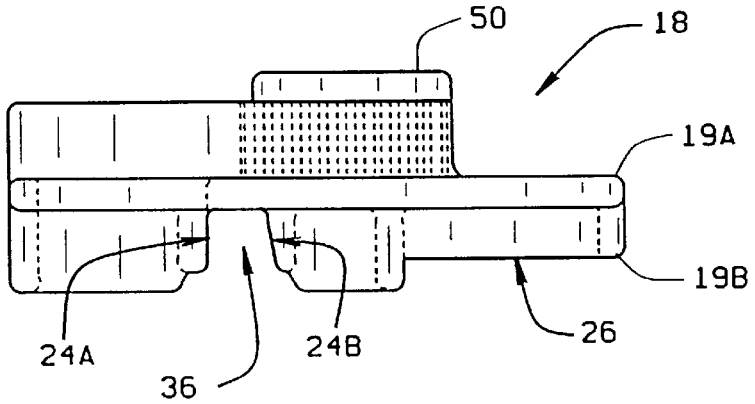
FIG. 3 is a side view of an actuator plate of FIG. 1.

As shown in FIGS. 1 and 3, second surface 19B of plate 18 has extending therefrom a first foot 24A and a second foot 24B, preferably substantially parallel to each other. There is provided between feet 24A, 24B a space 36 for receiving therein toggle lever 28, when cover member 35B is in the closed position. When the cover member is in the closed position and the toggle lever is positioned between feet 24A, 24B (hereinafter the NORMAL position of switch actuator 11), handle 12 can be rotated to cause plate 18 to move in a first or second longitudinal direction, thereby causing either foot 24A or 24B to contact toggle lever and toggle lever 28 to an ON or OFF state.

On second surface 19B of plate 18, there is also provided a contact surface 26, adjacent to foot 24B. When cover member 35B is in the closed position, contact surface 26 is positioned over push button 30. Handle 12 can be moved towards housing 34 to cause contact surface 26 to press against push button 30, thereby actuating second switch 25B. The actuation of second switch 25B activates a test circuit which simulates a ground fault and trips first switch 25A. Note that contact surface 26 can be positioned adjacent to either feet 24A, 24B depending on the location of push button 30.

Figure 2:
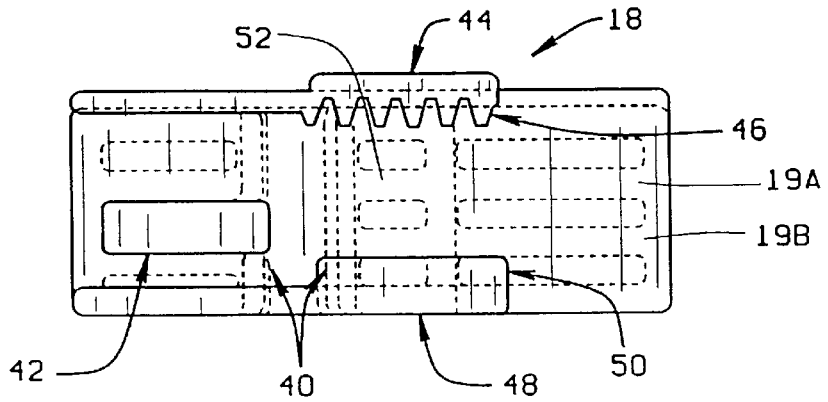
FIG. 2 is a plan view of an actuator plate of FIG. 1.
Figure 4:
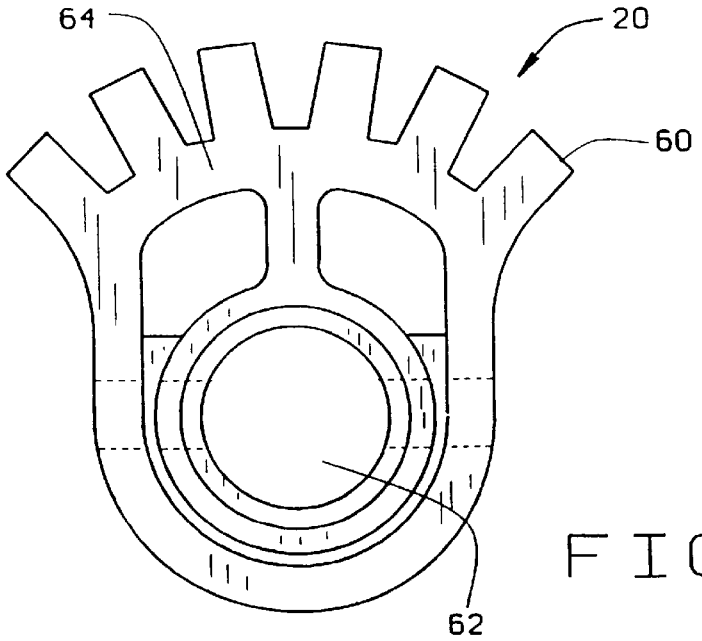
FIG. 4 illustrates a gear in accordance with the present invention.
Figure 5:
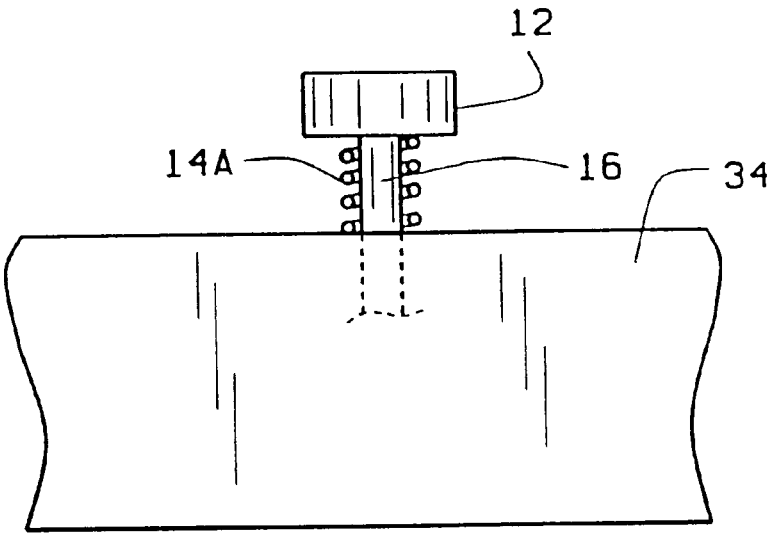
FIG. 5 illustrates a position of a handle and shaft of FIG. 1 in a NORMAL position.
Figure 6:
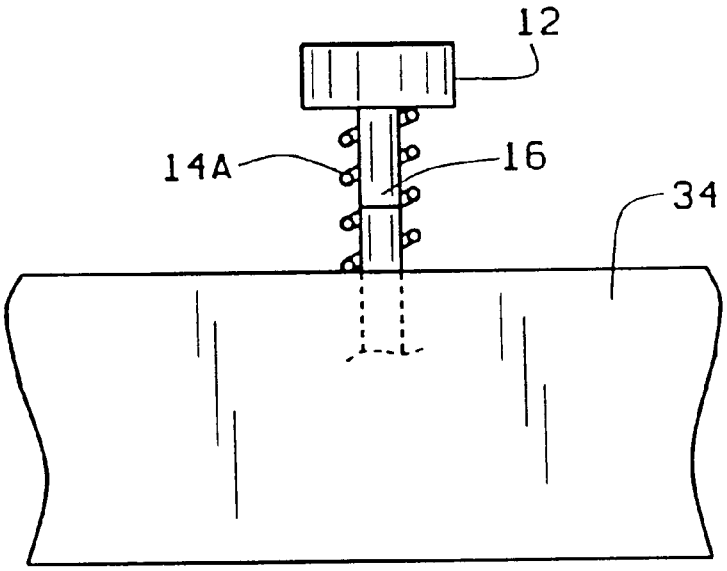
FIG. 6 illustrates a position of a handle and shaft of FIG. 1 in a MISALIGNED position.

Referring to FIG. 2, first surface 19A of plate 18 includes a gear rack 44 having a plurality of gear teeth 46 and an extending structure 48, opposite gear rack 44 and having a lip extending therefrom. A space 52 is provided between extending structure 48 and gear rack 44 for receiving gear 20 therein. As shown in FIG. 4, gear 20 includes a centrally positioned hole 62 for connecting to shaft 16 and a plurality of gear teeth 60 radially extending from a portion 64 of gear 20. When gear 20 is positioned in space 52 of plate 18, gear teeth 60 of gear 20 meshes with gear teeth 46 of gear rack 44 and lip 50 is positioned above gear 20, preferably over an edge of the gear, to movably secure the shaft assembly., i.e., the gear, shaft and handle, to plate 18. The above gear system converts rotational movement of shaft 16 and connected gear 20 to translational or linear movement of plate 18 in the longitudinal directions.

Plate 18 further includes a longitudinal slot 42 between first and second surfaces 19A, 19B, also shown in FIG. 2. Referring to FIGS. 1 and 2, a pin 22 connected to an interior surface of cover member 35B is positioned in slot 42 to keep plate 18 moving in the longitudinal and/or axial (to the shaft and pin) directions. It should be noted that pin 22 and plate 18 remain free from each other except for the limited travel allowed by longitudinal slot 42 in plate 18 and the travel afforded by a first spring 14A. By limiting travel along the longitudinal direction, t he task of realigning switch actuator 11, in the case of misalignment, is made simple and easy. That is to say, the range of the longitudinal movement of plate 18 can be preset so as to require less experimentation or play to realign plate 18 with toggle lever 28.

Referring again to FIG. 1, circuit operator 10 also includes a first compression spring 14A positioned around shaft 16 and between handle 12 and cover member 35B of housing 34. First spring 14A allows switch actuator 11 to return to the NORMAL position after handle 12 is pushed in an axial direction towards housing 34 to operate second switch 25B (i.e., the push to test feature). First spring 14A similar to longitudinal slot 42 of plate 18 (FIG. 2) limits movement along the axial direction and, likewise, simplifies the task of realigning switch actuator 11. In the interior of housing 34 (FIG. 1), there is also provided a second compression spring 14B positioned around shaft 16 and between an interior surface of cover member 35B of housing 34 and gear 20. Second spring 14B allows switch actuator 11 (i.e., the shaft assembly including handle, shaft and plate) to return to the NORMAL position if actuator 11 is realigned with toggle lever 28 of first switch 25A.

Provided herein is an example of an operation of the multi-switching function of the present invention. Initially, when cover member 35B is in the closed position, handle 12 may be used to operate externally either toggle lever 28 (i.e., the circuit breaker) or push button 30 (i.e., GFI switch). The former can be performed, for instance, by turning or rotating handle 12 in such a manner as to cause gear 20, within housing 34 and attached to handle 12 across shaft 16, to turn and engage gear rack 44 of plate 18. The rotation of gear 20 in turn is translated by gear rack 44 into a corresponding longitudinal or linear movement of plate 18. Therefore, if toggle lever 28 is in the ON position and handle 12 is turned toward the OFF position, plate 18 would be translated in such a manner to cause feet 24A, 24B of plate 18 to push toggle lever 28 of first switch 25A (i.e., circuit breaker) toward the OFF position and vice-versa.

Although switch actuator 11 and plate 18 are arranged with respect to a front panel or cover 35B as described above and shown in FIG. 1, switch actuator 11 and plate 18 may also be arranged with respect to a side panel or cover of housing 34 to operate toggle lever 28 and push button 30. In this case, handle 12 can be rotated to operate push button 30 or pushed and pulled to operate toggle lever 28.

When a GFI breaker is in the ON position, pushing handle 12 causes shaft 16 to move in the axial direction (along the axis of shaft 16) further into housing 34, spring 14A to be compressed and surface 19B of plate 18 to be moved towards push button 30. Surface portion 26 of plate 18 contacts push button 30 of second switch 25B (i.e., GFI switch) and activates a test circuit that trips first switch 25A, the circuit breaker. As this occurs, toggle lever 28 moves from the ON position to the TRIPPED position. The movement of toggle lever 28 exerts a force in the linear direction on plate 18, thereby causing plate 18 to move in the linear direction (along an axis of plate 18). The movement of plate 18, in turn, causes gear 20 to turn, via gear rack 44, and then shaft 16 to turn. The turning shaft causes handle 12 to turn and to indicate a new position of switch 25A. In this way, the position of toggle lever 28, i.,e., ON, TRIPPED or OFF state, is indicated by the external positioning of handle 12. Note that when handle 12 is released by the person operating switch actuator 11, compression spring 14A discharges and axially moves shaft 16 and components thereon (i.e., the components of switch actuator 11) towards the outside of housing 34, and to the NORMAL position.

Although switch 25A can be manually tripped by pushing handle 12 to activate a fault test, via push button 30, much of the operation described above would be the same if switch 25A tripped on its own accord.

Another feature of the present invention is the misalignment indicator, an example of which is provided below. Misalignment of plate 18 with toggle lever 28 may sometimes occur when cover member 35B of housing 12 is closed. In particular, this occurs where either foot 24A or 24B of plate 18 contacts an upper surface of toggle lever 28 (the MISALIGNED position), instead of being positioned on opposite sides of toggle lever 28 (the NORMAL position). This unexpected contiguity forces plate 18 to move in the axial direction towards housing 34 which, in turn, forces gear 20 and shaft 16 also to move in the axial direction towards housing 34. As a result, handle 12 moves away from housing 34 and compresses second spring 14B against the internal surface of housing 12. The movement of handle 12 as well as the distance between handle 12 and the exterior of housing 34 indicates the occurrence of a misalignment between switch actuator 11 and toggle lever 28.

In the event that switch actuator 11 is misaligned with toggle lever 28, switch actuator 11 can be simply and easily realigned by turning handle 12 in either directions. The longitudinal and axial movement of plate 18 are respectively limited by longitudinal slot 42 and pin 22, and first spring 14A. As previously discussed, the range of motion can be limited so that less experimentation is required to realign switch actuator 11 (particularly feet 24A, 24B of plate 18) with toggle lever 28. When switch actuator 11 is realigned with toggle lever 28, second spring 14B discharges and moves actuator 11 back to a normal position, i.e., handle 12 and shaft 16 moves back towards housing 34. As can be appreciated by those skilled in the art, actuator 11 can be simply and easily realigned without reopening cover member 35B or requiring cumbersome and time-consuming experimentation.

The invention having thus been described with particular reference to the preferred forms thereof, it will be obvious that various changes and modifications may be made therein without departing from the spirit and scope of the invention as defined in the appended claims.

We claim:

1. A circuit breaker operator comprising:

a housing body having an interior volume and a door mounted on the housing body for movement of the door between a closed position where the door encloses the housing interior volume and an opened position where the door provides access to the housing interior volume, and at least one hole passing through one of the housing body and the door, the at least one hole having a center axis;

a shaft passing through the at least one hole and being received therein for rotational movement and axial reciprocating movement relative to the at least one hole, the shaft having axially opposite exterior and interior ends; and a plate mounted in the housing interior volume for transverse movement of the plate relative to the center axis of the at least one hole, the plate being operatively connected to the shaft interior end to cause the plate to move transversely relative to the center axis of the at least one hole in response to rotation of the shaft in the at least one hole.

2. The circuit breaker operator of claim 1, wherein:

the plate is also mounted in the housing interior volume for axial movement of the plate relative to the center axis of the at least one hole, and the plate is operatively connected to the shaft interior end to cause the plate to move axially relative to the center axis of the at least one hole in response to axial movement of the shaft in the at least one hole.

3. The circuit breaker operator of claim 2, wherein:

the plate is operatively connected to the shaft interior end to cause a portion of the shaft in the at least one hole adjacent the shaft exterior end to be extended axially outside the at least one hole in response to the axial reciprocating movement of the plate toward the at least one hole.

4. The circuit breaker operator of claim 2, wherein:

the plate is operatively connected to the shaft interior end by a toothed rack on the plate and a gear on the shaft interior end, the gear engaging with the toothed rack to cause the plate to move transversely relative to the center axis of the at least one hole in response to the rotational movement of the shaft and gear, and the gear engaging with the plate to cause the plate to move axially relative to the center axis of the at least one hole in response to the axial reciprocating movement of the shaft in the at least one hole.

5. The circuit breaker operator of claim 4, wherein:

a handle is mounted on the shaft exterior end, a first spring is mounted on the shaft between the at least one hole and the handle and a second spring is mounted on the shaft between the at least one hole and the gear.

6. The circuit breaker operator of claim 1, wherein:

the plate is operatively connected to the shaft interior end to cause the plate to linearly reciprocate in opposite directions transverse to the center axis of the at least one hole in response to the rotational movement of the shaft in the at least one hole.

7. The circuit breaker operator of claim 1, wherein:

the plate has a first foot and a second foot that project outwardly from the plate and have a spacing for a switch toggle lever therebetween, and the plate has a switch push button contact surface.

8. The circuit breaker operator of claim 7, wherein:

the plate has opposite first and second surfaces, the plate first surface is operatively connected to the shaft interior end and the first foot and second foot project outwardly from the plate second surface.

9. The circuit breaker operator of claim 8, wherein:

the switch push button contact surface is on the second surface of the plate.

10. The circuit breaker operator of claim 1, wherein:

the at least one hole passes through the door.

11. The circuit breaker operator of claim 10, wherein:

the shaft and plate are supported on the door for movement with the door as the door is moved between the closed position and the opened position relative to the housing body.

12. A circuit breaker operator comprising:

a housing body having an interior volume and at least one hole passing through the housing body, the at least one hole having a center axis;

a shaft passing through the at least one hole and being received therein for rotational movement and axial reciprocating movement relative to the at least one hole, the shaft having axially opposite exterior and interior ends; and, a plate mounted in the housing interior volume for movement of the plate in a first movement relative to the center axis of the at least one hole, the plate being operatively connected to the shaft interior end to cause the plate to move in the first movement relative to the center axis of the at least one hole in response to the rotational movement of the shaft in the at least one hole.

13. The circuit breaker operator of claim 12, wherein:

the plate is also mounted in the housing interior volume for movement in a second movement, different from the first movement, relative to the center axis of the at least one hole and is also operatively connected to the shaft interior end to cause the plate to move in the second movement relative to the center axis of the at least one hole in response to the axial reciprocating movement of the shaft in the at least one hole.

14. The circuit breaker operator of claim 13, wherein:

the first movement of the plate is a linearly reciprocating movement and the second movement of the plate is an axially reciprocating movement.

15. The circuit breaker operator of claim 13, wherein:

the plate is operatively connected to the shaft interior end to cause a portion of the shaft in the at least one hole adjacent the shaft exterior end to be extended axially outside the at least one hole in response to movement of the plate toward the at least one hole.

16. The circuit breaker operator of claim 13, wherein:

the plate is operatively connected to the shaft interior end by a toothed rack on the plate and a gear on the shaft interior end, the gear engaging with the toothed rack to cause the first movement of the plate to be a transverse movement of the plate relative to the center axis of the at least one hole in response to the rotational movement of the shaft and rotation of the gear, and the gear engaging with the plate to cause the second movement of the plate to be an axial movement of the plate relative to the center axis of the at least one hole in response to the axial reciprocating movement of the shaft in the at least one hole.

17. The circuit breaker operator of claim 16, wherein:

a handle is mounted on the shaft exterior end, a first spring is mounted on the shaft between the at least one hole and the handle and a second spring is mounted on the shaft between the at least one hole and the gear.

18. The circuit breaker operator of claim 13, wherein:

the plate has a first foot and a second foot that project outwardly from the plate and have a spacing for a switch toggle lever therebetween, and the plate has a switch push button contact surface.

19. The circuit breaker operator of claim 18, wherein:

the plate has opposite first and second surfaces, the plate first surface is operatively connected to the shaft interior end and the first foot and second foot project outwardly from the plate second surface.

20. The circuit breaker operator of claim 19, wherein:

the switch push button contact surface is on the second surface of the plate.

21. The circuit breaker operator of claim 12, wherein:

the housing body includes a door that is mounted on the housing body for movement of the door between a closed position and an opened position relative to the housing body where in the closed position the door encloses the housing body interior volume and in the opened position the door provides access to the housing body interior volume, and the at least one hole passes through the door of the housing body.

22. The circuit breaker operator of claim 21, wherein:

the shaft and plate are supported on the door for movement with the door as the door is moved between the closed position and the opened position relative to the housing body.

* * * * *